United States Patent [19]

Peterson

[11] Patent Number: 4,947,776

[45] Date of Patent: Aug. 14, 1990

[54] CAMBERED FORESTAY FAIRING

[76] Inventor: Carleton Peterson, 6801 E. Menlo St., Mesa, Ariz. 85207

[21] Appl. No.: 264,530

[22] Filed: Oct. 31, 1988

[51] Int. Cl.[5] ..... B63H 9/06

[52] U.S. Cl. ..... 114/102; 114/39.1

[58] Field of Search ..... 114/39.1, 90, 102, 103; 244/219

[56] References Cited

U.S. PATENT DOCUMENTS

| | | | |
|---|---|---|---|
| 3,132,620 | 5/1964 | Court | 114/102 |
| 3,270,699 | 9/1966 | Bush | 244/219 |
| 3,866,558 | 2/1975 | Bergstrom et al. | 114/90 |
| 4,047,493 | 9/1977 | Menegus | 114/102 |
| 4,646,671 | 3/1987 | Innes et al. | 114/103 |

FOREIGN PATENT DOCUMENTS

| | | | |
|---|---|---|---|
| 384075 | 10/1923 | Fed. Rep. of Germany | 114/102 |
| 2001405 | 9/1971 | Fed. Rep. of Germany | 114/102 |
| 1409740 | 7/1965 | France | 114/102 |
| 2410599 | 6/1979 | France | 114/39 |

*Primary Examiner*—Sherman D. Basinger

*Assistant Examiner*—Thomas J. Brahan

*Attorney, Agent, or Firm*—Roger A. Marrs

[57] ABSTRACT

An elongated aerodynamically shaped fairing is disclosed herein having a body with a passageway at its rear for slideability receiving the bolt rope or cable of a sail and an interconnecting slot with the passageway for conducting a portion of the sail luff exteriorly of the fairing. The body of the fairing being provided with an internal cavity at its mid-section and extending forwardly so as to substantially enclose the length of a sailboat forestay. Pivotally carried within the cavity is a toggle member having a socket for bearing against and rotating about the forestay. Inflatable tubes are disposed on opposite sides of the toggle member and when selectively inflated and deflated, actuate the toggle member to flip to one side or the other of a central plane of the sail at its leading edge. A hydraulic or air pressure actuator is employed for selectively operating the tubes to achieve the desired toggle action of the toggle member to position and hold the fairing to allow for optimum leading edge camber of the sail on both port and starboard tacks.

6 Claims, 3 Drawing Sheets

20
30
33
42
21
40
26
℄ FAIRING
32
14
36
35
29
38
15
37
25
31
34
22
27
41
43
28

21
40
33
22
28
26
14
℄ FAIRING
15
38
20
41

21
40
42
14
25
15
33
41
43
22
28

CAMBERED FORESTAY FAIRING

BACKGROUND OF THE INVENTION

The present invention relates to aerodynamic fairings for a sailboat forestay and more particularly, to a novel controllable cambered forestay fairing which permits the optimum leading edge camber of the sail on both port and starboard tacks.

2. Brief Description of the Prior Art

In the past, it has been a conventional practice to slideably mount the leading edge of a sail onto the forestay of a sailboat by means of spaced-apart piston hanks or by means of an aerodynamic fairing which runs along the full length of the forestay and includes a slotted passageway for carrying the boltrope of the sail. However, problems and difficulties have been encountered when employing such devices which stem largely from the fact that a substantial amount of turbulence is experienced immediately behind the forestay at the crucial area of the sail's luff. Such turbulence is particularly experienced on the leeward side of the sail which greatly limits the sailboat's driving power to windward. Because of the relatively large angle of incidence between the sail and the apparent wind, a leading edge stall or luff occurs as the leading edge of the sail approaches the apparent wind.

When considering the conventional aerodynamics of a sailboat sail, it is well known that unless the oncoming wind is tangent to the forward surface of the sail, the air flow on the leeward side of the sail at its luff will cause turbulence and therefore loss of lift. However, the wind direction immediately in front of the sail is not the apparent wind direction The apparent wind actually bends to leeward just before it reaches the sail and therefore merely using an aerodynamic shape or the older piston hanks for attachment of the leading edge of the sail to the forestay will not reduce or eliminate the turbulence immediately behind the luff of the sail on the leeward side. Furthermore, as the sailboat changes tacks, the same amount of turbulence is experienced on the leeward side since there is no attempt to diverge or re-position the sail attachment with respect to the forestay. In other words, no means is provided for controllably moving the sail attachment means whether it is an aerodynamically shaped foil or piston hanks so as to eliminate the leeward turbulence problem.

Therefore, it has been a longstanding need to provide a novel attachment for the leading edge of a sail to a forestay or the like which permits the optimim leading edge camber of the sail on both port and starboard tacks so as to eliminate turbulence immediately behind the leading edge in the luff area of the sail on the leeward side.

SUMMARY OF THE INVENTION

Accordingly, the above problems and difficulties are obviated by the present invention which provides a forestay fairing having an elongated body of aerodynamic shape provided with a slotted passageway opening at its rearmost trailing edge to slideably receive and retain the leading edge of a sail and which is further provided with an internal cavity forward of its midsection for enclosing the forestay along its length. The fairing body includes a toggle member pivotally carried thereon at one end and having a socket formed in its opposite end to bear against and rotate directly on the forestay. Means are provided on opposite sides of the toggle member for selectively positioning the fairing body on one side or the other of a center line established as the boat centerline. Means are operably coupled to the actuator means for powering the movement of the fairing via the toggle member so that control of fairing positioning is in the hands of the boat operator or crew.

Therefore, it is among the primary objects of the present invention to provide a novel forestay fairing for mounting the headsail of a sailboat incorporating a streamlined fairing mounted on the headstay or forestay of the boat and which allows for the optimum leading edge camber of the sail on both port and starboard tacks.

Another object of the present invention is to provide a novel cambered forestay fairing for mounting the leading edge of a sail onto a forestay or headstay which may be selectively operated to greatly reduce, minimize or eliminate air turbulence directly on the leeward side of a sail regardless of the sailboat's point of sail.

Still another object of the present invention is to provide a novel cambered forestay fairing for mounting a headsail thereon such that the camber can be varied as a function as sail span (height) in order to obtain maximum aerodynamic efficiency of the entire sail.

Still a further object of the present invention is to provide a novel controllable cambered forestay fairing for a sailboat which creates not only an efficient sail with a higher L/D value, but one which is capable of driving the sailboat closer to the wind by being able to lower the angle of incidence between the sail and the apparent wind before a leading edge stall or luff occurs.

BRIEF DESCRIPTION OF THE DRAWINGS

The features of the present invention which are believed to be novel are set forth with particularlity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figure 1:
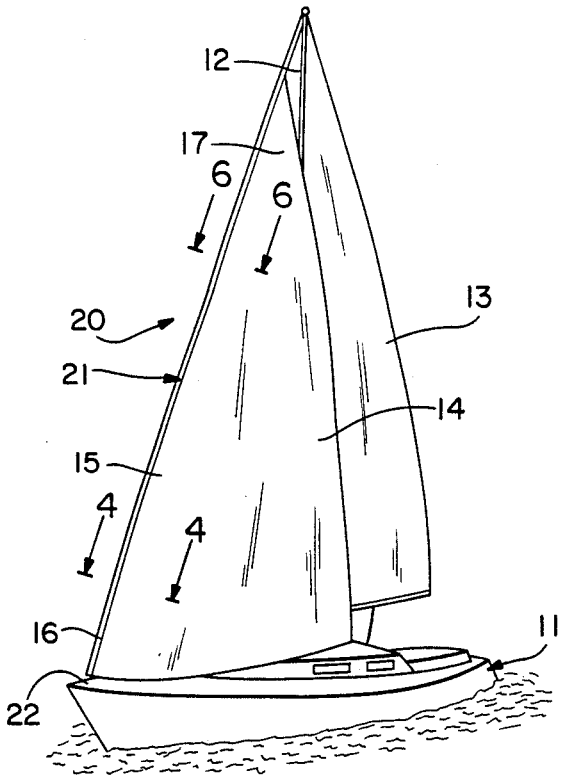
FIG. 1 is a perspective view of a sailboat incorporating the novel cambered forestay fairing of the present invention.

Referring to FIG. 1, a sailboat is illustrated by the numeral 11 which includes a hull for supporting a mast 12 having a mainsail 13 and a headsail 14. The headsail 14 includes a leading edge area which is identified by numeral 15 that extends from the tack 16 of the sail upwardly to the head 17 of the sail. The leading edge of the sail 14 adjacent to the luff area 15 is slideably carried in the inventive cambered forestay fairing of the present invention and generally illustrated in the direction of arrow 20. The fairing 20 includes an elongated body 21 which is supported on a headstay or forestay between the bow of the boat 11 and the top of the mast 12. Since the headstay or forestay is substantially encased by the body 21, the headstay or forestay is visible only at the adjacent areas between the ends of the body 21 and the respective boat bow 16 and mast 12. For purposes of illustration, the headstay or forestay is identified by numeral 22 at a location adjacent to the bow of the boat 11.

Figure 2:
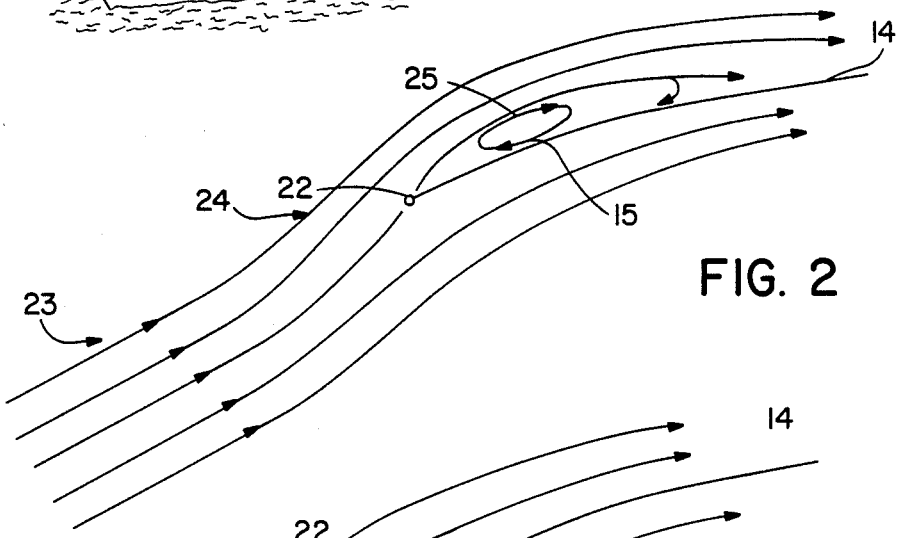
FIG. 2 is a diagramatic sketch showing existing airflow sequence about the luff of a sail attached to the forestay by conventional means.

Referring now in detail to FIG. 2, the conventional or existing airflow sequence or pattern is illustrated wherein the apparent airflow is indicated by the substantially parallel lines having arrowheads indicating the direction of flow. The airflow lines are collectively illustrated in the direction of arrow 23 and are illustrated passing about the forestay 22 on opposite sides of the sail 14 at the luff area 15. For purposes of comparison and explanation, the sail 14 is in a position normally employed when a sailboat is on port tack. The airflow directly in front of the sail is indicated in the general direction of arrow 24 and. it can be seen that as the flow continues beyond the forestay, a turbulent separation occurs in a pocket 25 on the leeward side of the sail 14 followed by a re-attachment of the airflow further back from the forestay and the pocket 25. It is this turbulence in a conventional sail arrangement that prevents the sail from having a lower angle of incidence between the luff of the sail and the apparent wind so that leading edge stall or luff occurs early as the bow of the boat approaches the wind. Therefore, forward drive of the boat is reduced and it is said that the boat cannot point or travel close to the wind.

Figure 3:
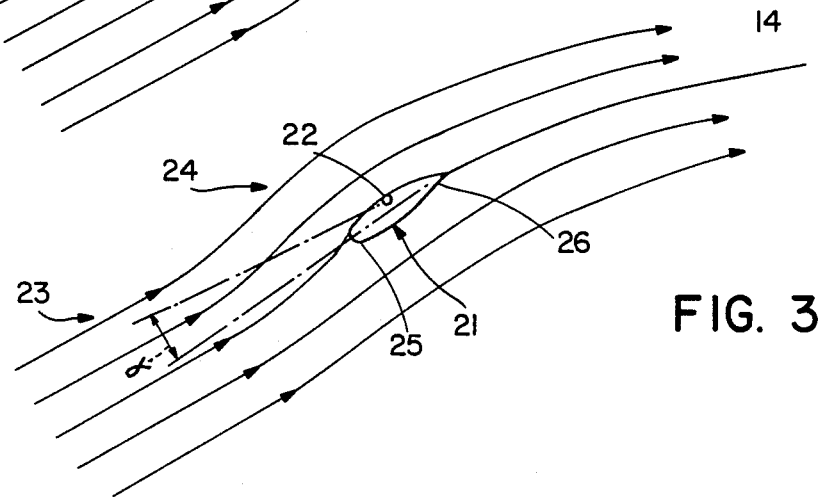
FIG. 3 is a view similar to the diagram of FIGURE 2 illustrating the inventive airflow sequence when employing the cambered forestay fairing of the present invention.

Referring now to FIG. 3, an airflow sequence or pattern is illustrated which is produced as a result of the inventive concept of the present invention. It is noted that the body 21 of the fairing is of aerodynamic configuration having a curved forward portion 25 and a tapered rear portion 26. Also, as the airflow approaches the body 21 which is of streamlined configuration, the airflow is parallel to the sail plane at its leading edge. Also, it is particularly to be noted that the pocket 25 of turbulent air is substantially reduced or non-existent. It can also be seen that the elimination of turbulent airflow is a direct result of positioning the body 21 on the headstay or forestay 22 so that the headstay is not lying on the central longitudinal axis of the body 21. Therefore, it can be seen that by positioning the fairing body 21 about the forestay 22, a cambered leading edge shape is obtained to the sail/fairing combination on both port and starboard tacks. The camber can be varied as a function of sail span (height) in order to obtain maximum aerodynamic efficiency of the entire sail. Therefore, the system creates not only a more efficient sail with a higher L/D value, but provides a system which can drive the boat closer to the wind by being able to lower the angle of incidence between the sail and the apparent wind before a leading edge stall or luff occurs.

Figure 4:
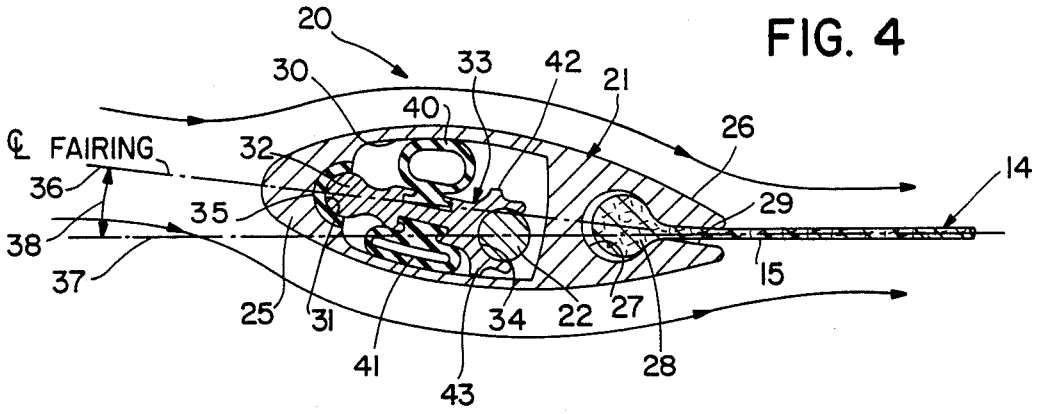
FIG. 4 is a transverse cross-sectional view of the cambered forestay fairing employed in the sailboat of FIG. 1 as taken in the direction of arrows 4—4 thereof.

Referring now in detail to FIG. 4, a transverse cross-section of the body 21 is illustrated which shows that the rear of the body 21 includes a slotted passageway 27 for holding the boltrope 28 of the sail 14. The passageway 27 is connected exteriorly via a slot 29 exiting at the trailing edge of the streamlined configured body 21.

At the midsection of the body 21 and continuing substantially forward thereof, there is provided an internal cavity 30 which encloses the forestay 22. The body 21 includes a thickened portion at its forward end 25 that is provided with a semi-circular aperture 31 for rotatably receiving a rounded bead or end 32 of a toggle member 33. The opposite end of the toggle member 33 includes a socket 34 which bears against and rotatably receives the forestay 22. Preferably, a resilient pad composed of a suitable elastomeric material is indicated by numeral 35 and is located within the aperture 31 against which the beaded end 32 of the toggle member 33 bears. The central longitudinal axis of the fairing body 21 is indicated by numeral 36 and the plane of the sail as it enters the fairing 21 pointing toward the axis of the forestay 22 is indicated by numeral 37. The angle between the axis 36 and axis 37 is indicated by numeral 38. In the orientation illustrated in FIG. 4, the boat is on starboard tack substantially as illustrated in FIG. 1 and the fairing body is maintained at this angle by an actuator means taking the form of inflatable tubes 40 and 41 located on opposite sides of the midsection of the toggle member 33. Since the tube 41 is deflated and the tube 40 is inflated, a positive force is imparted against the toggle member 33 to cause the body 21 to favor the position shown in FIG. 4. On the other hand, when the tube 40 is deflated and the tube 41 is inflated, the opposite orientation occurs which is shown in FIG. 5 and the setting is for sailing on port tack.

One means of securing the flexible tubes to the midsection of the toggle member 33 is to provide the midsection with slots so as to receive extensions of the tubes which are insertably received therein. Other forms of actuation as well as construction may be employed for moving the toggle member from one position to the other.

Figure 5:
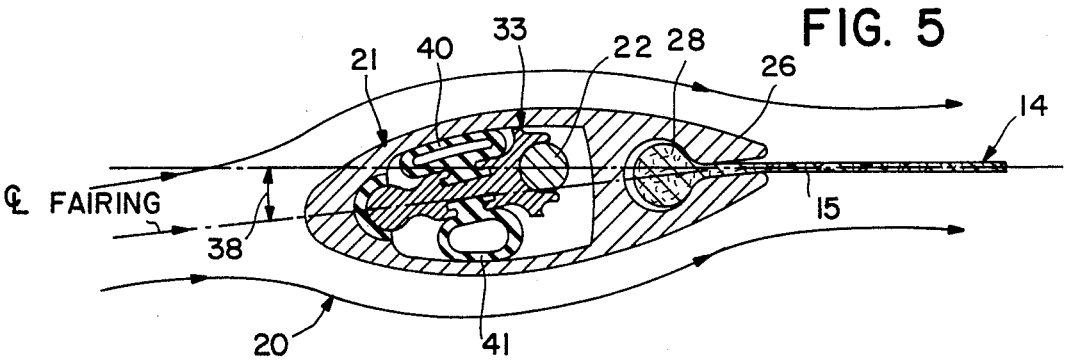
FIG. 5 is a transverse cross-sectional view similar to the view shown in FIG. 4 with the sail on port tack.

In both FIGS. 4 and 5, it can be seen that the toggle member 33 pivots about its beaded end 32 within the aperture 31 as moved by inflation and deflation of the respective flexible tubes 40 and 41. The amount of movement is adjustable by providing variable length toggle stops along the opposite sides of the toggle member 33 such as is indicated by numerals 42 and 43.

Figure 6:
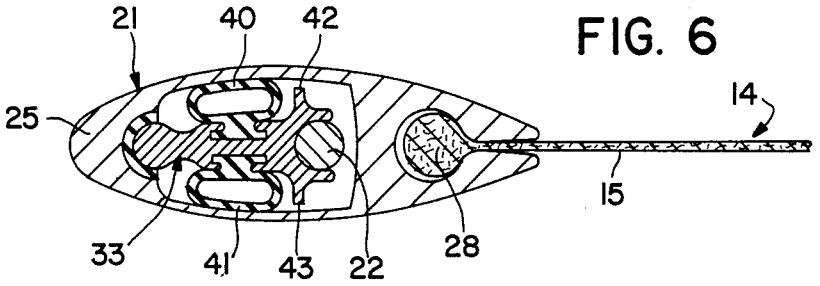
FIG. 6 is a transverse cross-sectional view similar to the views of FIGS. 4 and 5 as taken in the direction of arrows 6—6 of FIG. 1.

Referring now to FIG. 6, it can be seen that the stops 42 and 43 are substantially longer than those shown with respect to the cross-sections taken for FIGS. 4 and 5. The reason for this stems from the fact that the sail 14 experiences a substantial twist at the upper part of the sail and the body 21 need not be rotated as far as needs to be rotated along the lower part of the sail. Consequently, the movement of the toggle member is more restrictive due to the longer length. In fact, at the very head of the sail, the fairing body 21 is in substantially neutral position with respect to the central longitudinal axis 36 and the bow axis 37 so that the two axes are substantially co-extensive.

Figure 7:
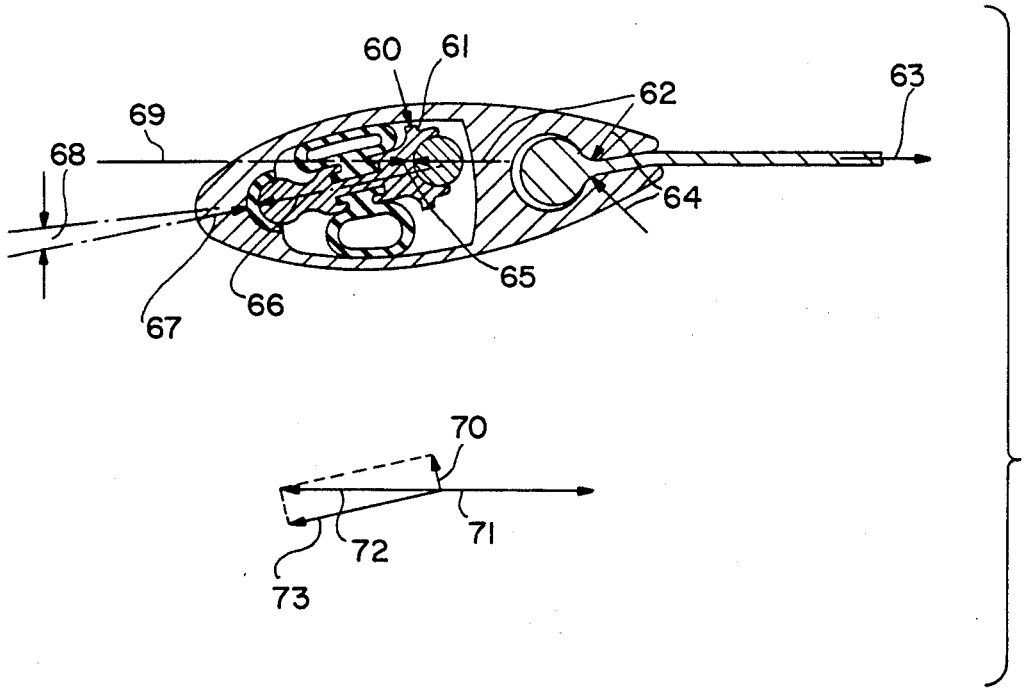
FIG. 7 is a diagramatic view showing a load analysis of the inventive cambered forestay fairing.

Referring now in detail to FIG. 7, a load analysis diagramming is illustrated in the form of vector illustration and the various load factors and resultant and reaction factors are indicated. Also, FIG. 7 shows toggle angle with respect to toggle loading on the fairing under conditions of sailing on port tack. Again, the descriptive material shown on the drawing describes the load factors.

Fairing reaction load 60
Toggle load on fairing 61
Forestay load 62
Sail load 63
Fairing Reaction load 64
Toggle Reaction load 65
Toggle load on fairing 66
Fairing Reaction load 67
Toggle angle 68
$C_L$ Fairing 69
Toggle load resultant 70
Sail load 71
Forestay load 72
Toggle load resultant 73

Figure 8:
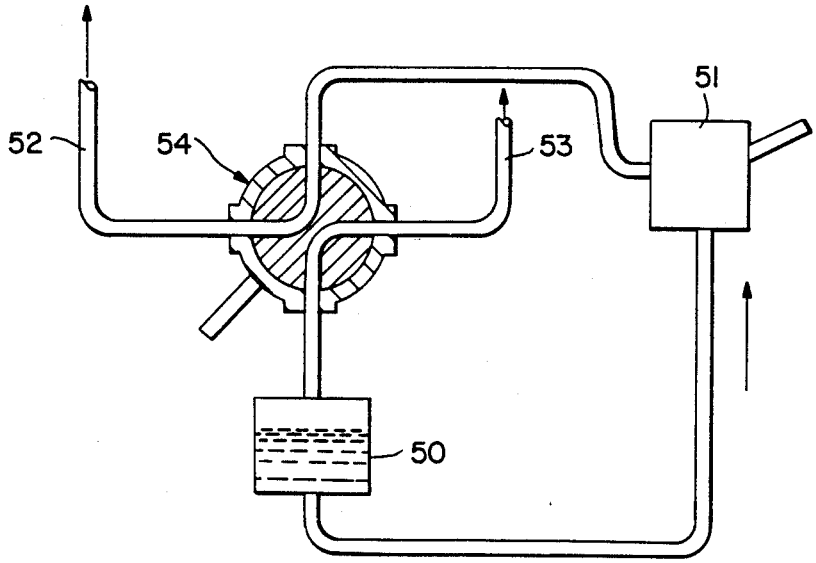
FIG. 8 is a diagramatic sketch of a hydraulic actuator system for controllably moving the forestay fairing from one tack to another.

Referring now in detail to FIG. 8, a hydraulic actuator system is illustrated for controlling the inflatable tubes 40 and 41 respectively. A hydraulic reservoir 50 is shown connected to a hand pump 51 whereby oil may be produced to either lines 52 or 53 leading to inflatable tubes 40 and 41, respectively. A control valve is indicated by numeral 54 that may be readily employed for interconnecting lines 52 and 53 with the reservoir 50 for conditions of reversing the flow or for selectively deflating the tubes. An air pressure system can replace the hydraulic system to lower system weight.

In view of the foregoing, it can be seen that the invention relates to a sailboat headstay or forestay fairing of aerodynamic and streamlined shape which can be positioned about the forestay or headstay of a sailboat to obtain a cambered leading edge shape to the juncture of the sail luff with the fairing combination on both port and starboard tacks. The present invention is a device by which a streamlined fairing can be mounted on a forestay and allow for the optimum leading edge camber of the sail on both the port and starboard tacks. By placing the streamlined fairing in a selected cambered position, the turbulence normally encountered on the leeward side of the sail is eliminated.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A streamline fairing have a forward cavity surrounding the forestay of a sailboat and attached to the luff of the sailboat's foresail which can be held at a desired camber angle with respect to the said foresail when sailing on the port tack, as well as at the opposite camber angle on the sailboat's starboard tack, by means of toggle action between said foresail, said forestay, a toggle mounted with the forward cavity of the fairing, and the fairing itself;

one end of said toggle having a cylindrical shape coated in a cylindrical depression at the forward end of the forward cavity of the fairing which allows it to rotate within said cavity allowing the other end of the toggle to swing from one side of the cavity to the other side;

the aft end of said toggle has a cylindrical depression which keeps the forestay on the center line of said toggle and allows rotation therebetween;

the aerodynamic loads on the foresail adapted to pull the sail away from said forestay putting said fairing in tension and said toggle in compression forcing said toggle to one side of said fairing or the other whereby to maintain equilibrium, the force of the sail passes through the center line of said forestay placing the center line of said fairing at a cambered angle with the leading edge of said foresail;

an expandable tube is installed on each side of said toggle which, when expanding one tube and reducing the other, forces said toggle off dead center to the proper side of said fairing to obtain the desired camber angle;

said cylindrical shaped forward end of said toggle and the said cylindrical depression of said fairing is separated by a cylindrical elastomer to reduce torsional friction therebetween.

2. The invention as defined in claim 1, wherein:

stop means carried on opposite sides of said toggle adjacent said forestay for limiting movement of said toggle by engaging with fairing wall surface.

3. The invention as defined in claim 2, wherein:

said stop means are of differing lengths as selected locations along the entire length of said fairing with the maximum limiting of movement substantially near the top of said forestay and with the minimum limiting of movement substantially near its bottom.

4. The invention as defined in claim 3, wherein:

said fairing body includes a leading edge and a trailing edge; toggle means being said body positioning by said effective to move said body leading edge across the center plane of said leading edge of sail so as to create a high L/D value which can drive said sailboat closer to the wind by lowering the angle of attack between the leading edge of said headsail and the apparent wind to preclude a stall or luff condition.

5. A cambered forestay fairing for a sailboat comprising the combination of:

a sailboat having a hull and an upstanding mast with a forestay supporting a headsail and extended between the bow of said hull and the top of said mast for supporting a headsail and the aft loads on said mast;

a rotatable, elongated fairing of aerodynamic streamlined configuration surrounding said forestay over the entire length of the luff of said headsail;

said fairing includes a body having a slotted passageway at its aft end for slideably carrying said headsail, and an internal cavity forwardly disposed of said slotted passageway for encling said forestay;

toggle means disposed in said body cavity and operably connected between said body and said forestay to urge said body to yaw about said forestay;

actuator means operably coupled to said toggle means for forcibly urging said body to move from one position to another allowing for the optimum leading edge camber of said headsail on either the port or starboard tacks;

said toggle means includes a semicircular aperture provided in said body;

a toggle member having a rounded bead at one end rotatably carried in said semicircular aperture and pivoting on said forestay;

said actuator means includes a pair of expandable tubes disposed in said body cavity and separated by the midsection of said toggle member;

means coupled to said tubes for selectively expanding and reducing said tubes for positioning said toggle member;

said toggle means further includes a resilient element disposed in said semicircular aperture against which said rounded bead of said toggle member bears;

stop means carried on opposite sides of said toggle member adjacent said forestay for limiting movement of said toggle member by engaging with a body wall surface defining said internal body cavity; and said stop means are of differing lengths at selected locations along the entire length of said body with the maximum limiting of movement substantially near the top of said mast and with the minimum limiting of movement substantially near the bow of said hull.

6. The invention as defined in claim 5 wherein:

said fairing body includes a leading edge and a trailing edge;

said body positioning by said toggle means being effective to move said body leading edge across the center line of said hull so as to create a high L/D value which can drive said hull closer to the wind by lowering the angle of incidence between the leading edge of said headsail and the apparent wind before experiencing a stall or luff condition.

* * * * *